US006557723B2

(12) United States Patent
Chen

(10) Patent No.: US 6,557,723 B2
(45) Date of Patent: May 6, 2003

(54) HANGABLE STORING BOX FOR A STACK OF PLASTIC BAGS

(75) Inventor: Cheng-Chang Chen, Hsin-Chuang (TW)

(73) Assignee: Bobson Hygiene International Inc., Hsin-Chuang (TW)

( * ) Notice: Subject to any disclaimer, the term of this patent is extended or adjusted under 35 U.S.C. 154(b) by 11 days.

(21) Appl. No.: 09/906,300

(22) Filed: Jul. 16, 2001

(65) Prior Publication Data

US 2003/0010788 A1 Jan. 16, 2003

(51) Int. Cl.[7] ..... A47K 10/24
(52) U.S. Cl. ..... 221/45; 206/554
(58) Field of Search ..... 221/26, 33, 34, 221/45, 46, 48, 55; 206/554, 494, 233

(56) References Cited

U.S. PATENT DOCUMENTS 1,953,887 A * 4/1934 Medoff ..... 206/37
5,695,065 A * 12/1997 Kennedy et al. ..... 206/494

* cited by examiner

*Primary Examiner*—Kenneth W. Noland
(74) *Attorney, Agent, or Firm*—Ladas & Parry

(57) ABSTRACT

A hangable storing box includes first and second housing halves defining an inner space therebetween, and a limiting plate disposed between the first and second housing halves and separating the inner space into front and rear spaces. A hook member projects from a rear wall of the first housing half for holding a stack of seamed plastic bags. The limiting plate has a bottom end spaced apart from bottom walls of the first and second housing halves to define thereamong a gap so as to permit the plastic bags to extend downwardly from the hook member through the rear space and the gap and then turn around the bottom end of the limiting plate to extend upwardly into the front space.

2 Claims, 5 Drawing Sheets

HANGABLE STORING BOX FOR A STACK OF PLASTIC BAGS

BACKGROUND OF THE INVENTION

1. Field of the Invention

This invention relates to a hangable storing box for a stack of seamed plastic bags.

2. Description of the Related Art

FIG. 1 illustrates a conventional manner of hanging a stack of seamed plastic bags 70 on a hook member 72 that is normally mounted on a wall (not shown). Each of the seamed plastic bags 70 can be torn along a seamed line so as to be separated apart from the stack of the seamed plastic bags 70. However, such hanging manner is disadvantageous in that the stack of the seamed plastic bags 70 tend to be undesirably torn from the hook member 72 or several of the seamed plastic bags 70 tend to be simultaneously torn and separate from the stack of the seamed plastic bags 70 when only one of the seamed plastic bags 70 is intended to be used. Moreover, the assembly of the hook member 72 and the plastic bags 70 has an untidy appearance.

FIG. 2 illustrates a conventional storing box 76 for storing a stack of folded plastic bags 74. However, the storing box 76 requires folding of each plastic bag 74. Moreover, there is a tendency that several of the folded plastic bags 74 can be simultaneously pulled out from the storing box 76 when only one of the plastic bags 74 is intended to be used.

SUMMARY OF THE INVENTION

Therefore, the object of the present invention is to provide a hangable storing box that is capable of overcoming the aforementioned drawbacks.

According to the present invention, a hangable storing box for storing a stack of seamed plastic bags comprises: rectangular first and second housing halves which are pivoted to each other and which define an inner space therebetween, the first housing half having top and bottom walls, a rear wall, two opposite side walls, and a hook member projecting from the rear wall toward the second housing half for holding the stack of the plastic bags, the second housing half having top and bottom walls associated with the top and bottom walls of the first housing half, a front wall opposite to the rear wall, two opposite side walls associated with the side walls of the first housing half, and a front opening formed in the front wall for access to the inner space and the stack of the plastic bags; and a limiting plate disposed between the first and second housing halves, pivoted to one of the side walls of the first and second housing halves, separating the inner space into front and rear spaces, and having a bottom end spaced apart from the bottom walls of the first and second housing halves to define thereamong a gap so as to permit the plastic bags to extend downwardly from the hook member through the rear space and the gap and then turn around the bottom end of the limiting plate to extend upwardly into the front space.

BRIEF DESCRIPTION OF THE DRAWINGS

In drawings which illustrate an embodiment of the invention.

DETAILED DESCRIPTION OF THE PREFERRED EMBODIMENT

Figure 1:
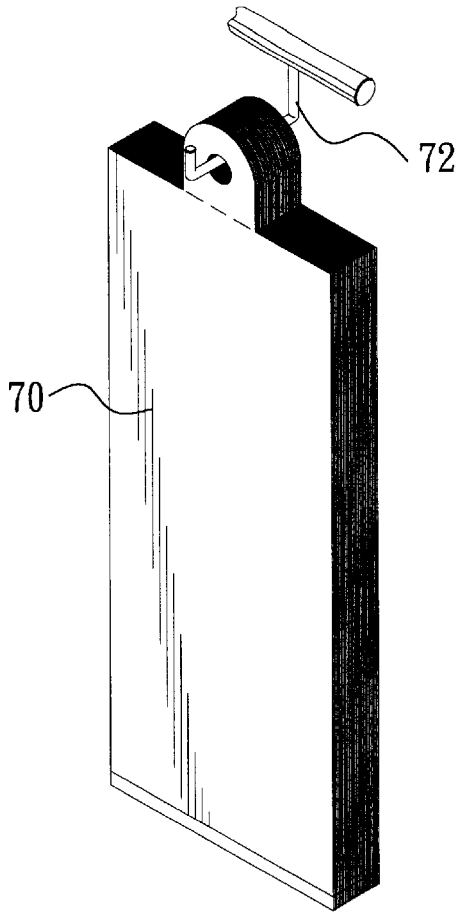
FIG. 1 PRIOR ART
FIG. 1 illustrates a conventional hanging manner of hanging a stack of seamed plastic bags.
Figure 2:
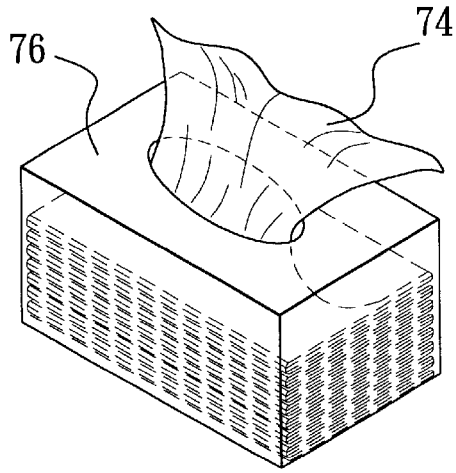
FIG. 2 PRIOR ART
FIG. 2 illustrates a conventional storing box for storing a stack of folded plastic bags.
Figure 3:
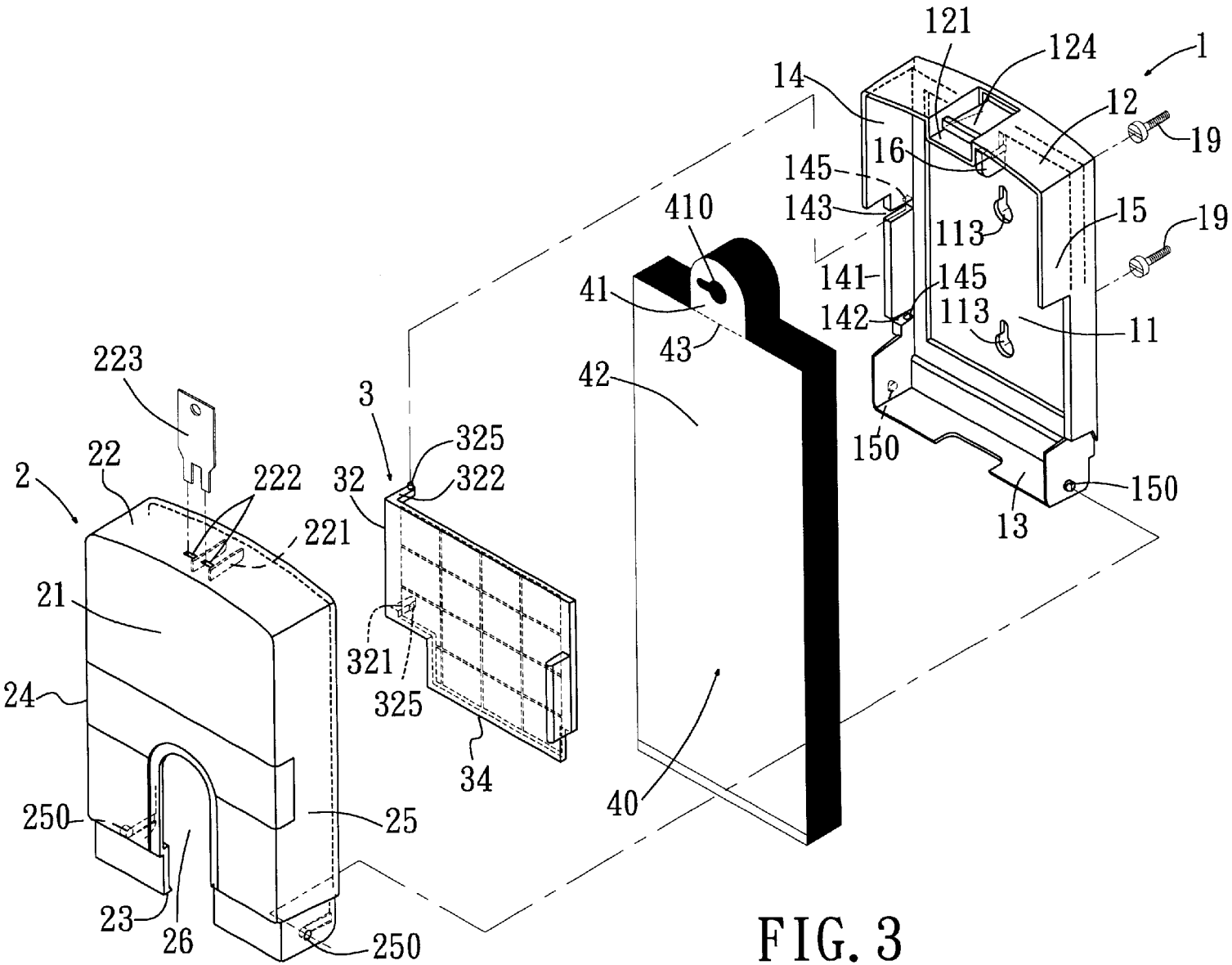
FIG. 3 is an exploded perspective view illustrating a hangable storing box embodying this invention for storing a stacked of seamed plastic bags.
Figure 4:
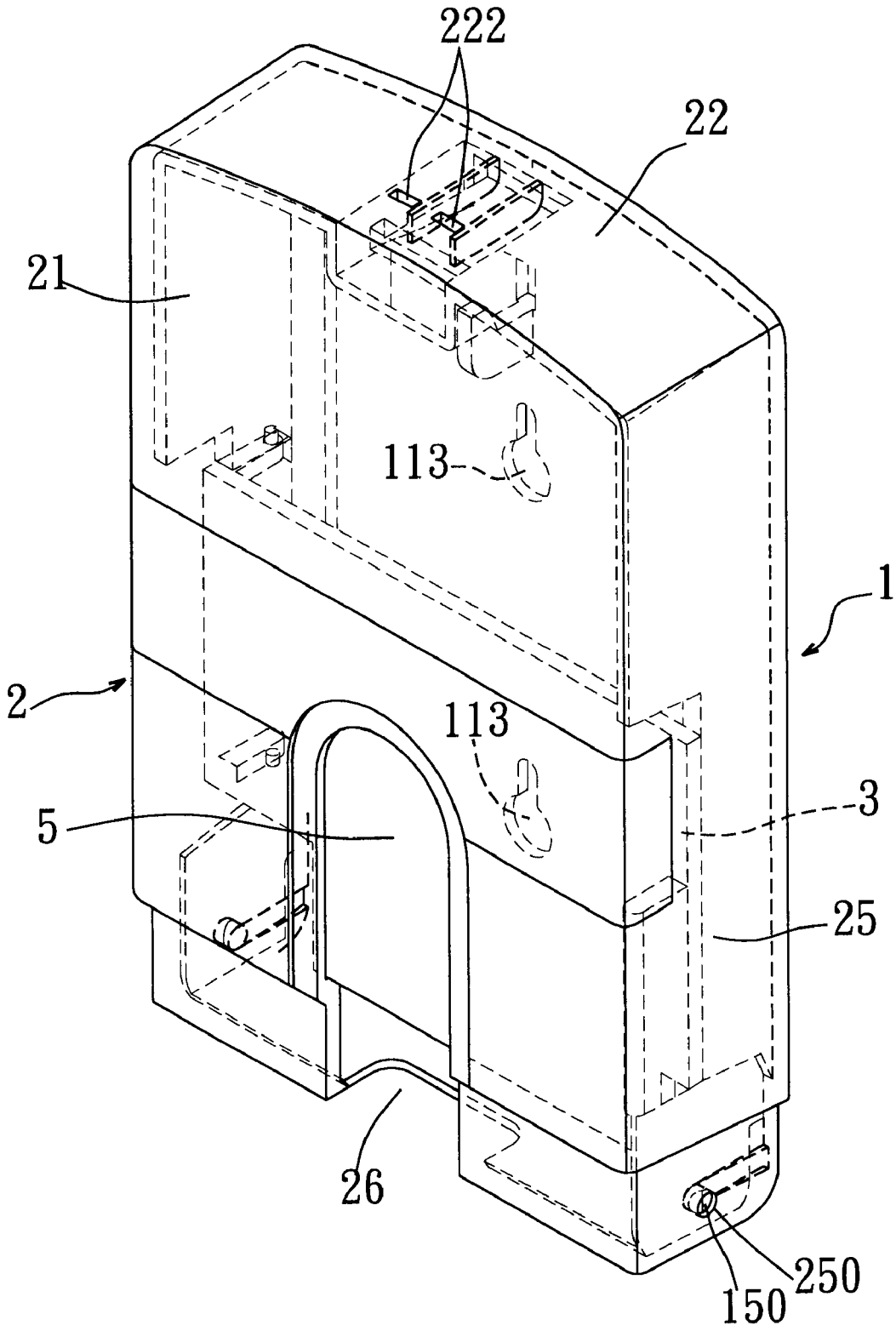
FIG. 4 is a perspective view of the storing box of FIG. 3.
Figure 5:
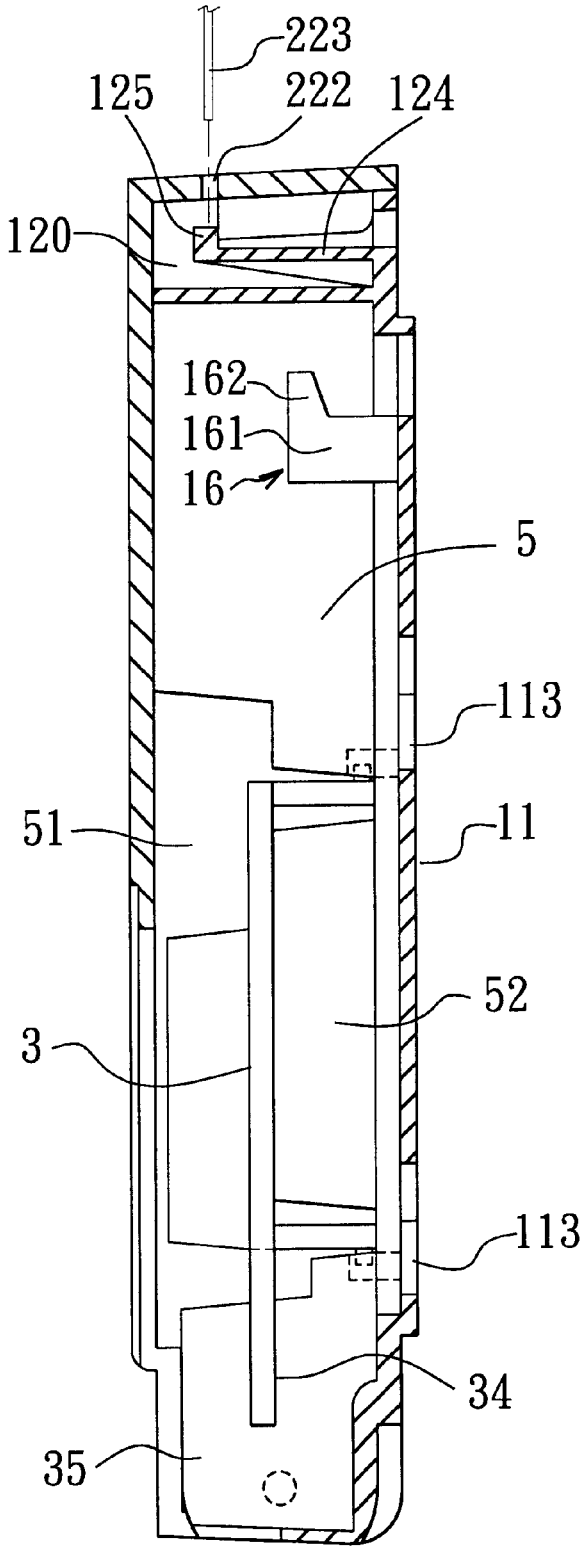
FIG. 5 is a cross-sectional view of the storing box of FIG. 3.
Figure 6:
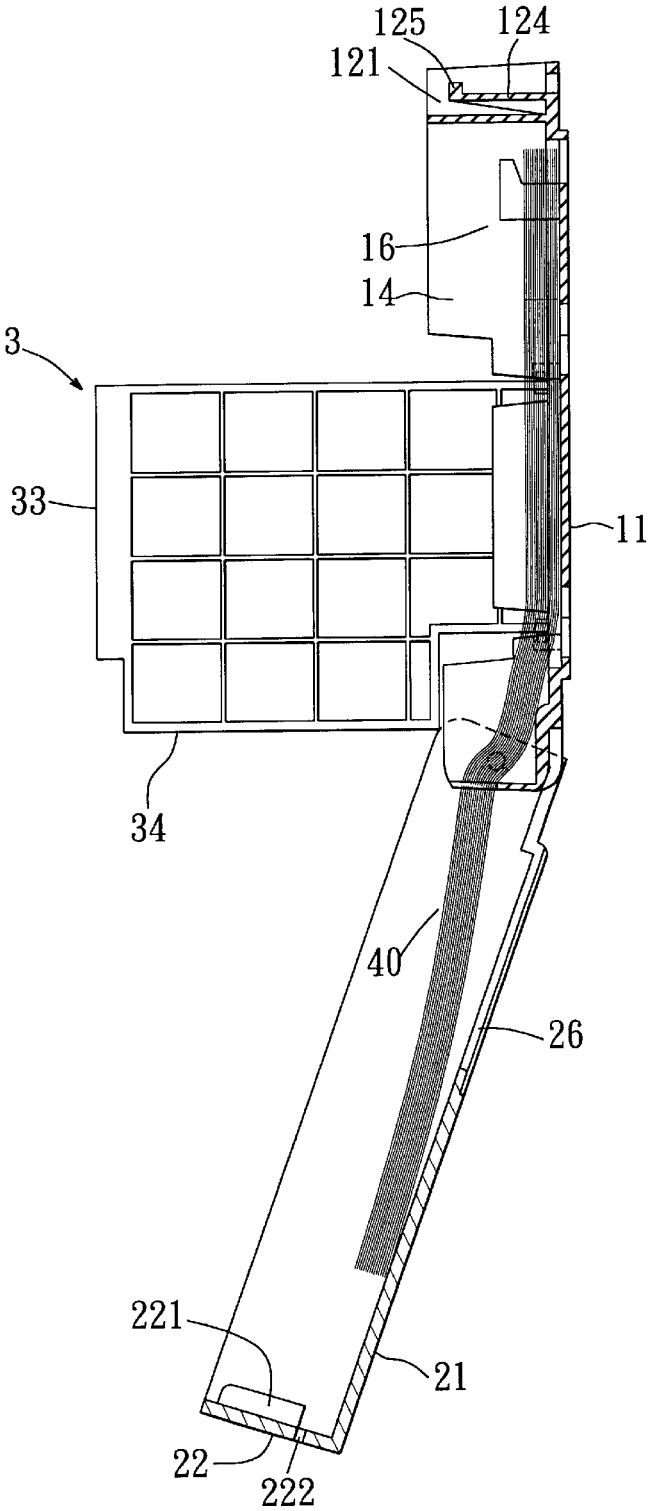
FIG. 6 is another cross-sectional view to illustrate the stack of the plastic bags, which is disposed in the storing box of FIG. 3 in an unfolded state.
Figure 7:
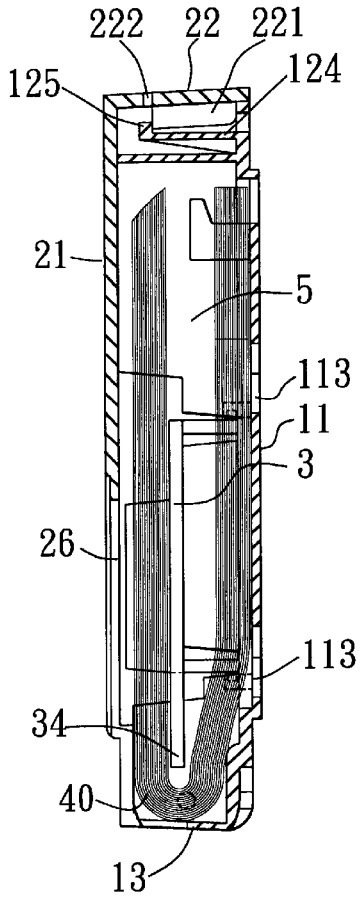
FIG. 7 is another cross-sectional view to illustrate the stack of the plastic bags, which is disposed in the storing box of FIG. 3 in a folded state.

FIGS. 3 to 7 illustrate a preferred embodiment of a hangable storing box of this invention for storing a stack of seamed plastic bags 40.

Each of the seamed plastic bags 40 has a hanging portion 41 with a hole 410, a storing portion 42, and a seam portion 43 connected to the hanging and storing portions 41, 42.

The storing box includes: rectangular first and second housing halves 1, 2 which are pivoted to each other and which define an inner space 5 therebetween, the first housing half 1 having top and bottom walls 12, 13, a rear wall 11, two opposite side walls 14, 15, a pair of retaining holes 113 formed in the rear wall 11 to permit the storing box to be hung on a wall (not shown) via supporting members 19, and a hook member 16 projecting from the rear wall 11 toward the second housing half 2 and extending through the holes 410 in the plastic bags 40 for holding the stack of the plastic bags 40, the second housing half 2 having top and bottom walls 22, 23 associated with the top and bottom walls 12, 13 of the first housing half 1, a front wall 21 opposite to the rear wall 11, two opposite side walls 24, 25 associated with the side walls 14, 15 of the first housing half 1, and a front opening 26 formed in the front wall 14 for access to the inner space 5 and the stack of the plastic bags 40; and a limiting plate 3 disposed between the first and second housing halves 1, 2, pivoted to one of the side walls 14 of the first and second housing halves 1, 2, separating the inner space 5 into front and rear spaces 51, 52, and having a bottom end 34 spaced apart from the bottom walls 13, 23 of the first and second housing halves 1, 2 to define thereamong a gap 35 SO as to permit the plastic bags 40 to extend downwardly from the hook member 16 through the rear space 52 and the gap 35 and then turn around the bottom end 34 of the limiting plate 3 to extend upwardly into the front space 51.

A notch 141 is formed in one of the side walls 14. A pair of spaced apart upper and lower slits 143, 142 are formed in the one of the side walls 14, and extend inwardly from an edge of the notch 141. A pair of spaced apart upper and lower pivot protrusions 322, 321 project from one end 32 of the limiting plate 3 in a direction perpendicular to the limiting plate 3 and into the upper and lower slits 143, 142.

First tongue-and-groove means 150, 250 are provided on the side walls 14, 15, 24, 25 of the first and second housing halves 1, 2 adjacent to the bottom walls 13, 23 of the first and second housing halves 1, 2 so as to permit the second housing half 2 to be turnable about a horizontal axis that is perpendicular to the side walls 14, 15, 24, 25 of the first and second housing halves 1, 2.

Second tongue-and-groove means 145, 325 are provided on one of the side walls 14 of the first housing half 1 within the upper and lower slits 143, 142 and the upper and lower pivot protrusions 322, 321 so as to permit the limiting plate 3 to be turnable about a vertical axis that is parallel to the side walls 14, 15, 24, 25 of the first and second housing halves 1, 2.

The top wall 12 of the first housing half 1 is formed with a top recess 121 extending inwardly relative to the inner space 5. A locking unit includes a spring arm 124 that projects horizontally from the rear wall 11 into the top recess 121 and that has a free anchored end 125, and a pair of locking protrusions 221 that project downwardly from the top wall 22 of the second housing half 2 into the top recess 121 to engage releasably the anchored end 125 of the spring arm 124 so as to lock the second housing half 2 to the first housing half 1. A pair of inserting holes 222 are formed adjacent to the locking protrusions 221. A key member 223 is insertable into the inserting holes 222 so as to abut against and press the spring arm 124 downwardly in order to disengage the locking protrusions 221 from the anchored end 125 of the spring arm 124 and to permit the second housing half 2 to be turnable about the horizontal axis.

Due to the presence of the limiting plate 3, the stack of the plastic bags 40 is able to be folded around the former, thereby significantly reducing the size of the storing box. Moreover, the aforementioned drawbacks associated with the prior art can be eliminated.

With the invention thus explained, it is apparent that various modifications and variations can be made without departing from the spirit of the present invention. It is therefore intended that the invention be limited only as recited in the appended claims.

I claim:

1. A hangable storing box for storing a stacked of seamed plastic bags, comprising:

rectangular first and second housing halves which are pivoted to each other and which define an inner space therebetween, said first housing half having top and bottom walls, a rear wall, two opposite side walls, and a hook member projecting from said rear wall toward said second housing half for holding the stack of the plastic bags, said second housing half having top and bottom walls associated with said top and bottom walls of said first housing half, a front wall opposite to said rear wall, two opposite side walls associated with said side walls of said first housing half, and a front opening formed in said front wall for access to said inner space and the stack of the plastic bags;

a limiting plate disposed between said first and second housing halves, pivoted to one of said side walls of said first and second housing halves, separating said inner space into front and rear spaces, and having a bottom end spaced apart from said bottom walls of said first and second housing halves to define thereamong a gap so as to permit the plastic bags to extend downwardly from said hook member through said rear space and said gap and then turn around said bottom end of said limiting plate to extend upwardly into said front space;

first tongue-and-groove means provided on said side walls of said first and second housing halves adjacent to said bottom walls of said first and second housing halves so as to permit said second housing half to be turnable about a horizontal axis that is perpendicular to said side walls of said first and second housing halves; and second tongue-and-groove means provided on one of said side walls of said first housing half and one end of said limiting plate so as to permit said limiting plate to be turnable about a vertical axis that is parallel to said side walls of said first and second housing halves.

2. The hangable storing box of claim 1, wherein said top wall of said first housing half is formed with a top recess extending inwardly relative to said inner space, said hangable storing box further comprising a locking unit that includes a spring arm projecting horizontally from said rear wall into said top recess and having a free anchored end, and at least a protrusion projecting downwardly from said top wall of said second housing half into said top recess to engage releasably said anchored end of said spring arm so as to lock said second housing half to said first housing half.

* * * * *